United States Patent [19]

Kido

[11] 3,931,928

[45] Jan. 13, 1976

[54] APPARATUS FOR SEPARATING A MIXED LIQUID CONTAINING COMPONENTS OF DIFFERENT SPECIFIC GRAVITIES

[76] Inventor: Jitsuo Kido, 6-23, 1 chome Kiyota-cho, Yahata, Kitakyushu, Fukuoka, Japan

[22] Filed: Jan. 16, 1974

[21] Appl. No.: 433,896

[30] Foreign Application Priority Data

| | | |
|---|---|---|
| Jan. 20, 1973 | Japan | 48-9027 |
| Jan. 23, 1973 | Japan | 48-10128 |
| Feb. 9, 1973 | Japan | 48-16269 |
| Mar. 28, 1973 | Japan | 48-35371 |
| June 12, 1973 | Japan | 48-66006 |
| Aug. 13, 1973 | Japan | 48-90757 |
| Sept. 10, 1973 | Japan | 48-101856 |

[52] U.S. Cl. ..... 233/21; 233/27; 233/31

[51] Int. Cl.[2] ..... B04B 11/06

[58] Field of Search ..... 233/1 R, 3, 21, 27, 28, 233/29, 31

[56] References Cited

UNITED STATES PATENTS

| | | | |
|---|---|---|---|
| 347,702 | 8/1886 | Evans | 233/21 |
| 1,710,447 | 4/1929 | Bryson | 233/21 |
| 2,551,815 | 5/1951 | Schulz | 233/11 |
| 2,587,206 | 2/1952 | Pattinson | 233/21 |

*Primary Examiner*—George H. Krizmanich

*Attorney, Agent, or Firm*—Frank J. Jordan

[57] ABSTRACT

Apparatus for separating a mixed liquid containing components of different specific gravities includes an inner cylinder rotatably disposed in an outer cylinder. The mixed liquid is introduced into the inner cylinder and the latter has a concentric opening at one longitudinal end thereof through which separated components of lesser specific gravity pass. Disk means are disposed at one longitudinal end portion of the inner cylinder and is arranged such that generally inner and outer concentric columns of separated components of lesser and greater specific gravities respectively are formed in the inner cylinder. Operable means lead from the outer concentric column of separated components of higher specific gravity to a discharge opening in the outer cylinder and is operable to mitigate the effects of centrifugal force on the separated liquid component of heavier specific gravity as the latter pass to discharge.

8 Claims, 10 Drawing Figures

APPARATUS FOR SEPARATING A MIXED LIQUID CONTAINING COMPONENTS OF DIFFERENT SPECIFIC GRAVITIES

BACKGROUND OF THE INVENTION

This invention relates to an apparatus for separating a mixed liquid containing components of different specific gravities.

Heretofore, a mixed liquid containing components of different specific gravities, such as oil and water, were drained from a source and introduced into a cistern or a pool so that the liquid would naturally separate itself into two layers as the lighter liquid component floated to the surface. However, a wide area for the separating pool was required for such an operation and also it took a long time to complete the separating operation. Further, there is a great need for an apparatus which serves to completely collect oil floating on the sea or other body of water due to a marine accident or the like at a low cost and in a short period of time.

The present invention overcomes the aforementioned disadvantages of known prior art arrangements and satisfies the aforementioned by utilizing the centrifugal force generated by rotation of a cylindrical chamber within a separating structure, in which liquid from a source is continuously and completely separated into two cylindrical layers of different specific gravities, such as oil and water, each of which passes separately out of outlets disposed at the upper part and the lower part of the apparatus.

Accordingly, an object of the present invention is to provide an apparatus for separating a mixed liquid consisting of two kinds of liquid having different specific gravities, continuously with scientific exactitude.

Another object of the present invention is to provide an apparatus which may be used for collecting raw petroleum floating on the sea or other body of water due to a marine accident continuously and smoothly in a short period of time at low cost without requiring expensive chemical treatment.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

SUMMARY OF THE INVENTION

Apparatus for separating a mixed liquid containing components of different specific gravities includes an outer cylinder having a discharge opening at a lower portion thereof through which separated components of higher specific gravity are discharged. An inner cylinder is rotatably disposed in the outer cylinder and drive means are provided for rotating the inner cylinder. An inlet introduces mixed liquid into the inner cylinder. The inner cylinder has a concentric opening at the upper longitudinal end thereof through which separated components of lesser specific gravity pass. A cover is mounted on the outer cylinder for receiving the separated components of lesser specific gravity from the concentric opening. Disk means are disposed at one longitudinal end portion of the inner cylinder and is arranged such that generally inner and outer concentric columns of separated components of lesser and greater specific gravities respectively extend between the disk means and the upper longitudinal end of the inner cylinder. Operable means leading from the outer concentric column of separated components of higher specific gravity to the discharge opening in the outer cylinder is operable to mitigate the effects of centrifugal force on the separated liquid component of heavier specific gravity as the latter passes to the discharge opening in the outer cylinder.

DESCRIPTION OF THE PREFERRED EMBODIMENTS

Figure 1:
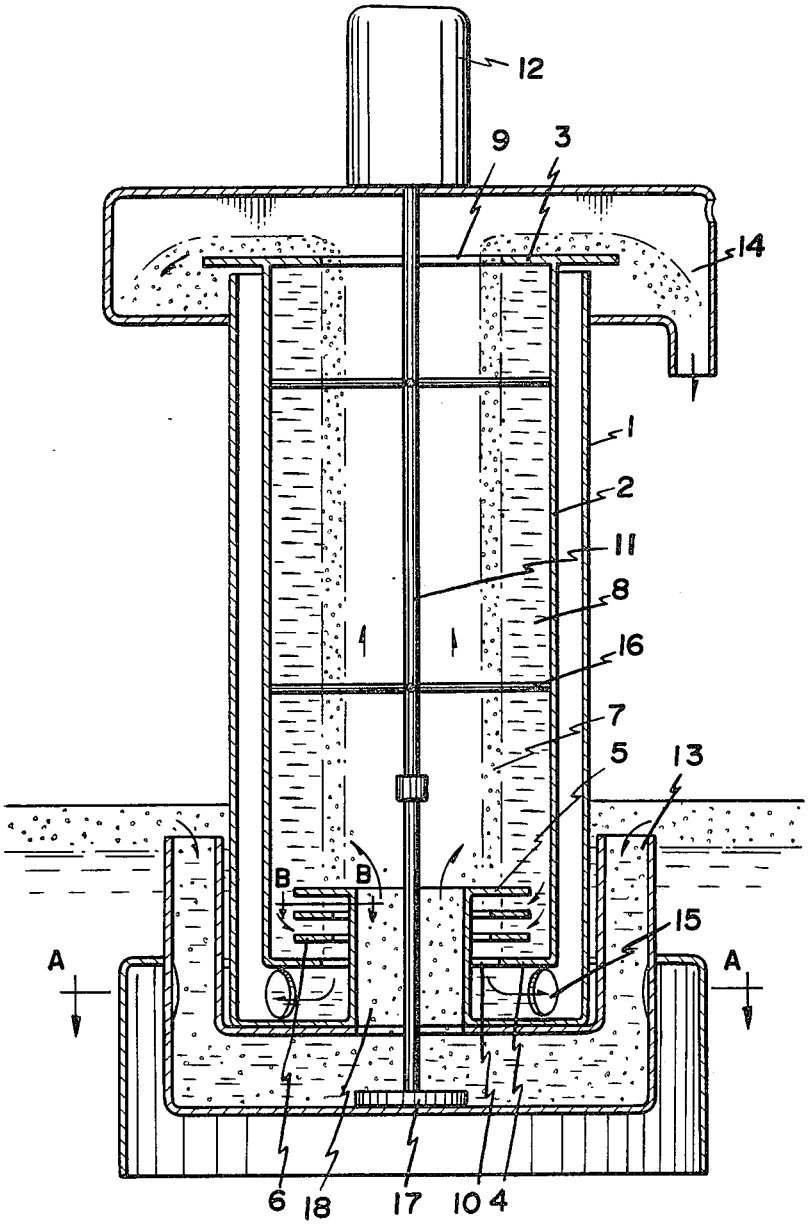
FIG. 1 is a vertical sectional view showing an apparatus for separating a mixed liquid according to a first embodiment of the present invention.
Figure 1A:
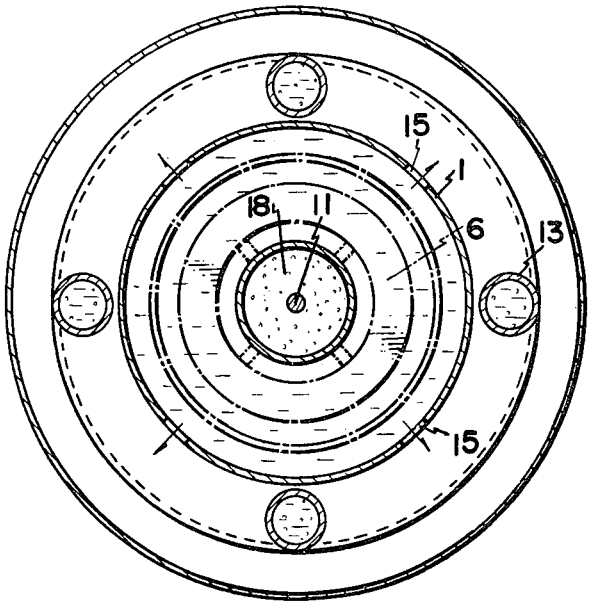
FIG. 1*a* is a sectional view taken along the line A—A in FIG. 1.
Figure 1B:
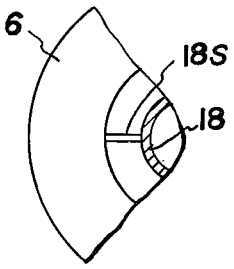
FIG. 1*b* is a partial sectional view taken along the line B—B in FIG. 1.
Figure 3A:
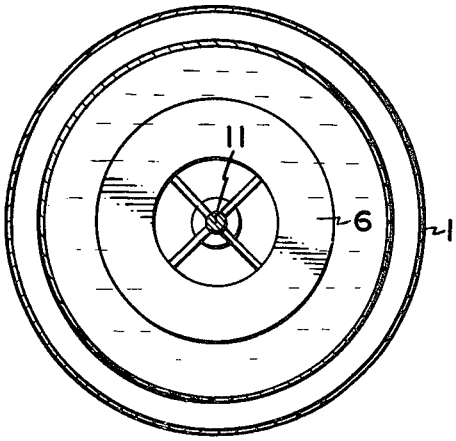
FIG. 3*a* is a sectional view taken along the line A—A in FIG. 3.

Referring to the drawings, FIG. 1 shows the basic structure of a first embodiment of the present invention in which there is provided an inner cylinder 2 having two ends 3 and 4 and which is installed in an outer cylinder 1 in such a manner that the inner cylinder 2 rotates separately from the outer cylinder 1 by means of a shaft 11 driven by an electric motor 12 disposed on the apparatus. At the lower part of the outer cylinder 1 there is provided a plurality of outlets 15 for discharging liquid of high specific gravity and at both ends 3, 4 of the inner cylinder 2, openings 9 and 10 of the same diameter are provided which are centered around the shaft 11. In the inner cylinder 2, a divisional disk 5 is attached to the top of an inlet passage 18 for introducing mixed liquid and further, a plurality of stationary spaced disks 6 for mitigating centrifugal force by dampening or retarding the movement of the liquid are secured to the inlet passage 18 by struts 18*s* and these disks 6 are arranged to form openings between the inlet passage 18 and the disks 6.

A cover 14 used as a casing for collecting liquid of lesser specific gravity is disposed on the outer cylinder 1 to collect and take out separated liquid of lesser specific gravity. A casing 13 including a plurality of inlet openings for introducing mixed liquid is formed at the lower part of the outer cylinder 2. The rotary shaft 11 extending from the electric motor 12 extends down to the bottom of the casing 13 and is disposed in a bearing support 17. From intermediate portions of the shaft 11 supporting bars 16 are provided which extend to the inner cylinder 2 to be fixed to the latter.

In the first embodiment of the present invention constructed with the foregoing elements, the apparatus is adapted to be first disposed in such a manner as to be located or partially submerged in the liquid over which oil or bubbles are floating. Just the lower half of the apparatus is disposed in the liquid. At this time the opening of the casing 13 is positioned in the floating oil. In such a disposition, the floating oil begins to flow into the inner cylinder 2 together with some quantity of water and passes above the divisional disk 5 through the casing 13 and the passage 18.

When the inner cylinder 2 is rotated by the motor 12 through the shaft 11 and the supporting bars 16 connected thereto, the mixed liquid of water and oil flowing into the inner cylinder 2 is effected by the centrifugal force generated by its rotation to be separated in accordance with the difference in specific gravities. Liquid of higher specific gravity, such as water, is centrifuged and accumulates around the inner surface of the cylinder 2 forming into the configuration of a liquid-cylinder 8 because it is more responsive to the centrifugal force. On the other hand, liquid of lower specific gravity, such as oil, forms another liquid cylinder 7 positioned on the divisional disk 5 inside the liquid-cylinder 8 of heavier specific gravity. Liquid of lesser specific gravity will pass out of the opening 9 into the cover 14 to be collected at a location not shown in the drawing if the inner diameter thereof is less than the diameter of the opening 9. Similarly, in such a condition, and referring to the lower part of the liquid cylinder 8 of higher specific gravity, the centrifugal force imparted to the liquid cylinder 8 is somewhat weakened or lessened by means of the divisional disk 5 and the disks 6 and the heavier liquid is directed to flow out of the outlet 15 through the lower opening 10.

Due to the above mentioned discharge both from the upper and the lower openings 9 and 10 respectively, it is possible that the hollow shape of the cylinder is always maintained within regular limits, and only liquid of small specific gravity rises up along the liquid cylinder of higher specific gravity and is collected separately from the heavier liquid.

Figure 2:
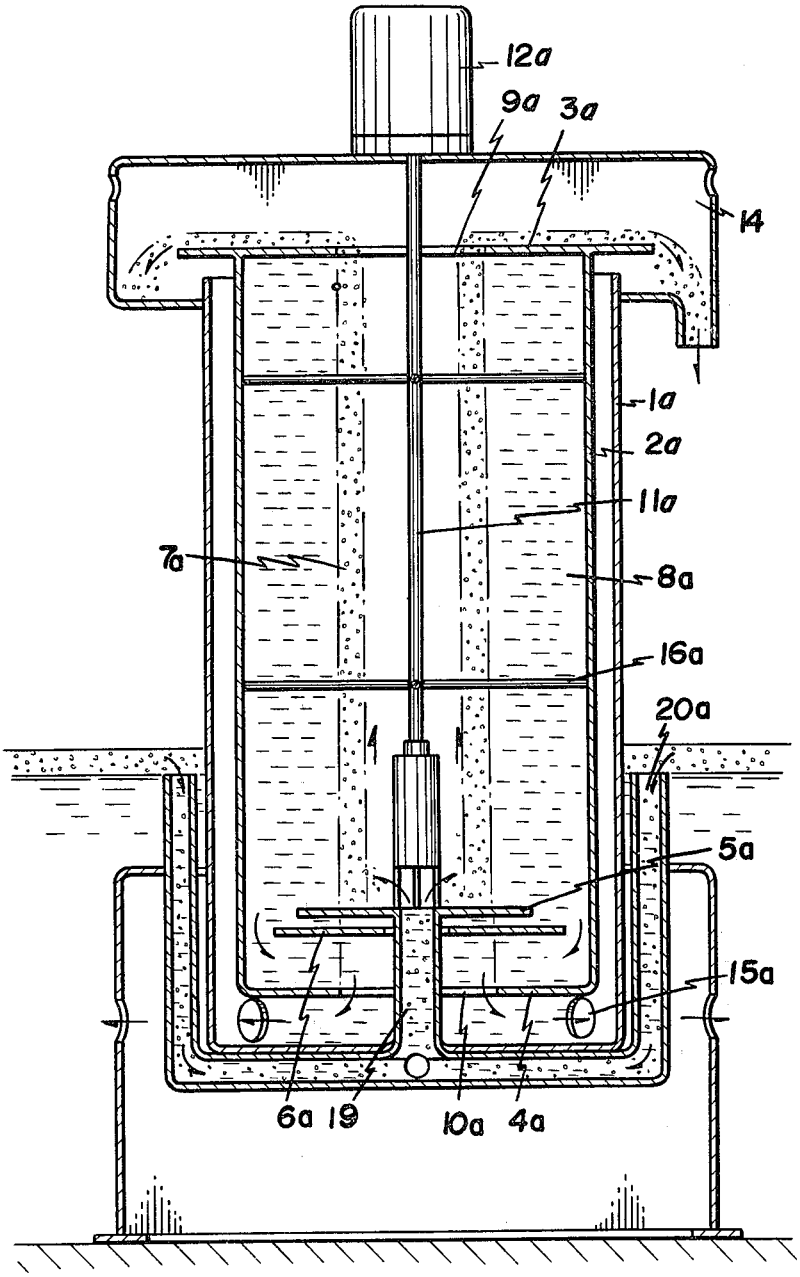
FIG. 2 is a vertical sectional view showing an alternate apparatus similar to the first embodiment but wherein the structure at the inlet portion for introducing liquid differs from that of FIG. 1.
Figure 3:
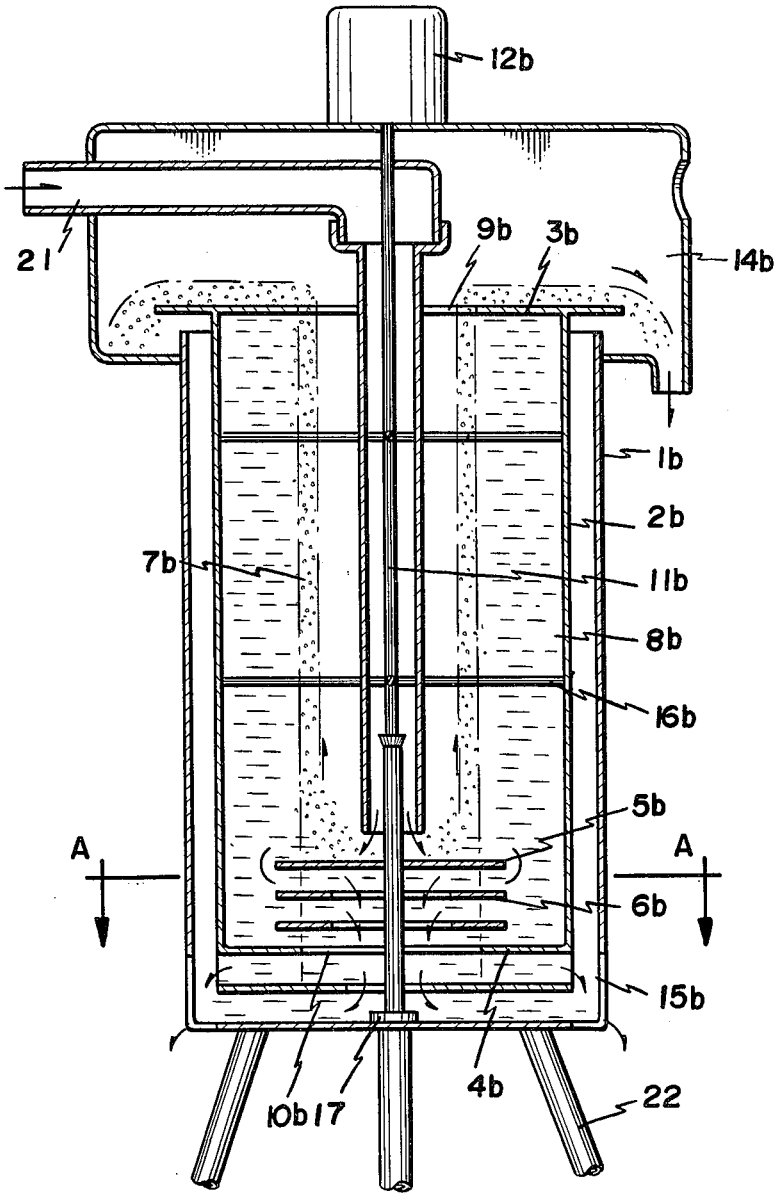
FIG. 3 is a vertical sectional view of another alternate embodiment showing another variation of the first embodiment in which mixed liquid to be separated flows from the upper part of the apparatus thereinto and pedestals are provided at the bottom thereof.

FIGS. 2 and 3 respectively represent variations of the first embodiment. In FIG. 2, an inlet passage 19 extends from four pipes 20 which are joined to each other at a cross just under the outer cylinder 1. The inlet passage 19 passes through the bottom of cylinder 1*a* and through opening 10*a* into inner cylinder 2*a* ending immediately below shaft 11*a*.

As regards the alternate variation shown in FIG. 3, the structure of the apparatus is more or less changed. In the example of FIG. 3, an inlet pipe 21 is formed to pass into the cover 14*b* to extend downwardly to enclose the shaft 11*b* and to open above the divisional disk 5*b*. Further, the apparatus is supported on pedestals 22. The operation of the variations of FIGS. 2 and 3 is substantially the same as the operation of the FIG. 1 variation hereinbefore described.

Figure 4:
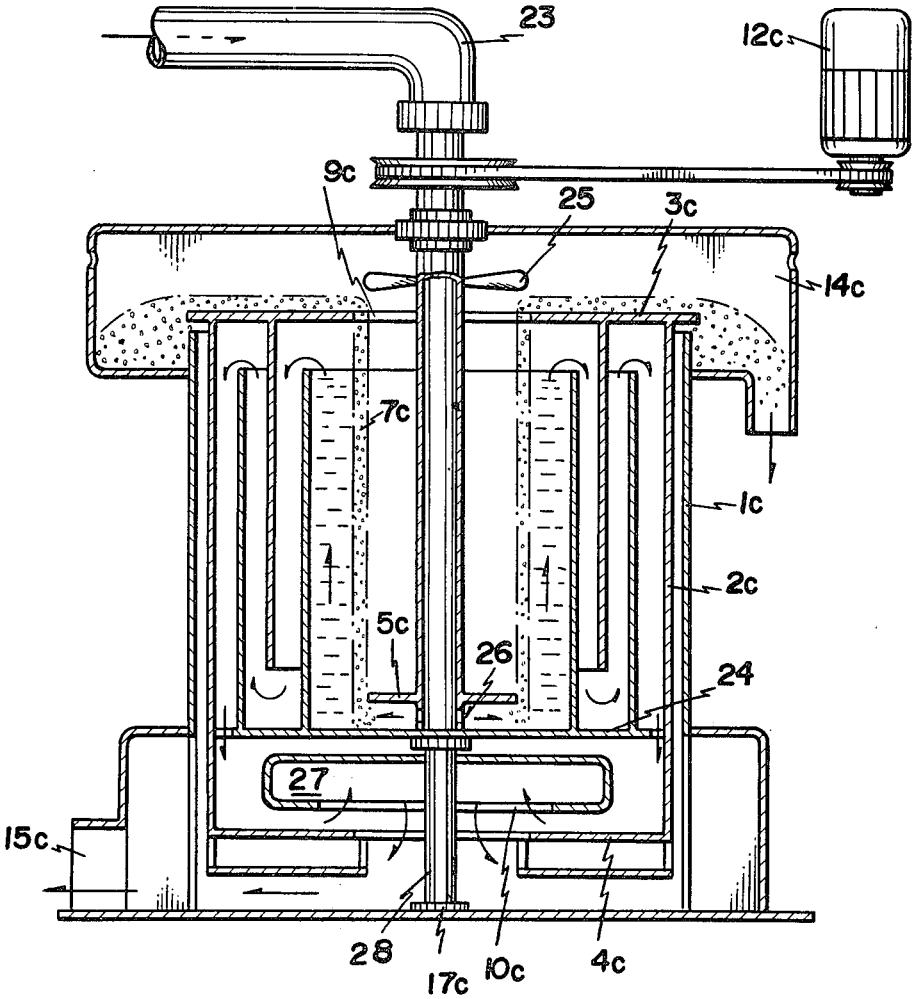
FIG. 4 is a vertical sectional view of another alternate embodiment showing the main part of an apparatus for separating a mixed liquid according to a second embodiment of the present invention.

A fourth embodiment of the present invention is constructed as shown in FIG. 4.

In FIG. 4 an outer cylinder 1*c* is provided with a cover 14*c* for collecting separated liquid of lesser specific gravity and an outlet 15*c* thereunder for discharging liquid of higher specific gravity. Within the outer cylinder 1*c* there is provided an inner cylinder 2*c* arranged so that it may rotate centering around an inlet pipe 23 for introducing mixed liquid from above. The inlet pipe 23 extends to an intermediate bottom end 24 of the inner cylinder 2*c* and includes vanes 25 at a position thereon in the cover 14*c*. At the lower part of the inlet pipe 23, a divisional disk 5*c* is provided and openings 26 for mixed liquid are located just under the divisional disk 5*c*. Between the top end 3*c* and the bottom end 4*c* of the inner cylinder 2*c* there is interposed an intermediate bottom end arranged in such a manner as to form outlet openings for separated liquid of higher specific gravity at both sides. The space defined by the top end 3*c* and the intermediate bottom end 24 is suitably partitioned with a plurality of concentric cylinder which are alternatively disposed in spaced apart relationship from the top end 3*c* and the intermediate bottom end 24 to define and complete an extended circuitous detour path leading to the outlet openings in the intermediate bottom end 24. Arranged about a supporting shaft 28, is a bottomless stationary chamber 27 for lessening or weakening the effect of the centrifugal force impacted to the liquid of higher specific gravity by suddenly retarding the movement of the liquid passing through the bottom part.

In the fourth embodiment shown in FIG. 4, when mixed liquid is introduced through the inlet pipe 23 into the inner cylinder 2*c* after the latter is rotating by means of the electric motor 12*c*, the liquid, as in the case of the first embodiment, is separated due to the centrifugal force into two cylindrical liquid-layers, that is, inner liquid layer 7*c* of lesser specific gravity and outer liquid layer 8*c* of higher specific gravity. The vanes 25 rotate, and generate a rising-flow of air contained in the mixed liquid in a state of bubbles to thereby allow the liquid of lesser specific gravity to rise. When the inner diameter of the liquid of lesser specific gravity decreases to less than the diameter of the opening 9*c* at the top end of the inner cylinder 2*c*, it is discharged through the cover 14*c*. The liquid layer 8*c* of higher specific gravity positioned outside the above mentioned liquid of lesser specific gravity passes toward the top end 3*c* and the intermediate bottom end 24 a few times in taking a roundabout or circuitous course along the extended path or detour, separating even the ingredient of smaller specific gravity remaining therein without being separated up. Liquid thus passing through all of the detour flows out of the openings located at the intermediate bottom end 24 to enter the chamber 27 disposed about the supporting shaft 28 so that it may flow out of the outlet at the bottom end of the outer cylinder 1*c* with lessened or weakened centrifugal force. The apparatus is designed in such a manner that both of the openings 9*c* and 10*c* have the same diameter and central point, and the diameter of the divisional disk 5*c* is smaller than that of the openings 9*c* and 10*c*.

Figure 5:
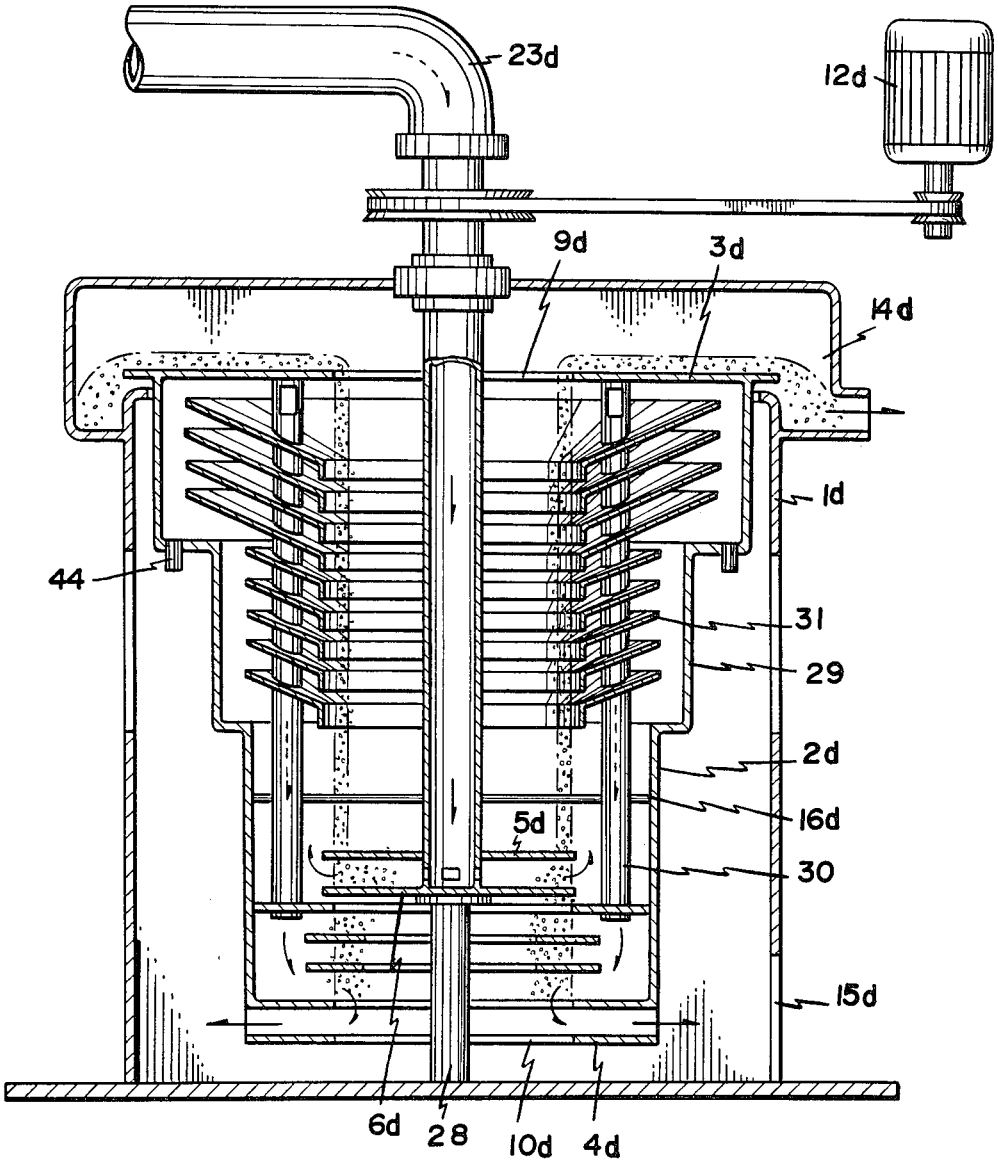
FIG. 5 is a vertical sectional view of another alternate embodiment showing the main part of an apparatus for separating mixed liquid according to a third embodiment of the present invention.

The structure of a fifth embodiment is shown in FIG. 5. In FIG. 5 an outer cylinder 1*d* is provided with an inner separating chamber 29 designed with a terraced or stepped configuration which contracts downwardly. The inner chamber 29 is rotated by means of an electric motor 12*d* via a pipe 23*d* which is also used as an inlet conduit for introducing the mixed liquid. Supporting bars 16*d* extending from the inlet pipe 23*d* and are fixed to the inner cylinder. Also in the inner cylinder of the apparatus, a top end 3*d* and a bottom end 4*d* thereof have concentric openings 9*d* and 10*d* of the same diameter, but the diameter of a divisional disk 5*d* located at the lower part of a shaft is designed to exceed the diameter of the above openings 9*d* and 10*d*. Between the top end 3*d* and the bottom end 4*d* of the inner cylinder, a desirable number of pipes 30 are arranged vertically for the purpose of permitting separated liquid of higher specific gravity to flow out of the inner cylinder into the outer cylinder 1*d*. A plurality of bottomless dished-plates 31 are arranged at regular intervals on the pipes 30. The bottomless dished-plates 31 have larger diameter openings as compared to the diameter of theopening 9*d*. Disks 6*d* for weakening and lessening the effect of centrifugal force are mounted on the supporting shaft 28 which includes outlet openings.

According to this fifth embodiment, mixed liquid flows into the inner cylinder 2*d* through an opening located at a lower portion of the inlet pipe 23*d* and rises up along the terraced wall of the inner cylinder as it is centrifuged by rotation of the inner cylinder 2*d*. Liquid of higher specific gravity is forced outside by the centrifugal force and separates from the liquid of lesser specific gravity remaining in the former liquid by the rotary action of the bottomless dished-plates 31 installed on the pipes 30, and the centrifuged liquid of lesser specific gravity gradually moves inwardly through the intervals or spaces between the dished-plates 31 to meet the layer of the liquid of lesser specific gravity formed in the shape of a cylinder on the divisional disk 5*d*.

On the other hand, liquid of higher specific gravity thus completely centrifuged enters the pipe 30 from openings disposed at the upper part thereof to be discharged into the lower chamber in which are included the disks 6*d* for weakening or lessening the effects of the centrifugal force and to flow out of the outlet 15*d*. Liquid centrifuged inside is in the shape of a cylinder and is discharged through the opening 9*d* into the cover 14*d* similarly as in the foregoing two embodiments. Sludge gathered in the inner separating chamber can be removed at regular intervals by means of plugs 44.

Figure 6:
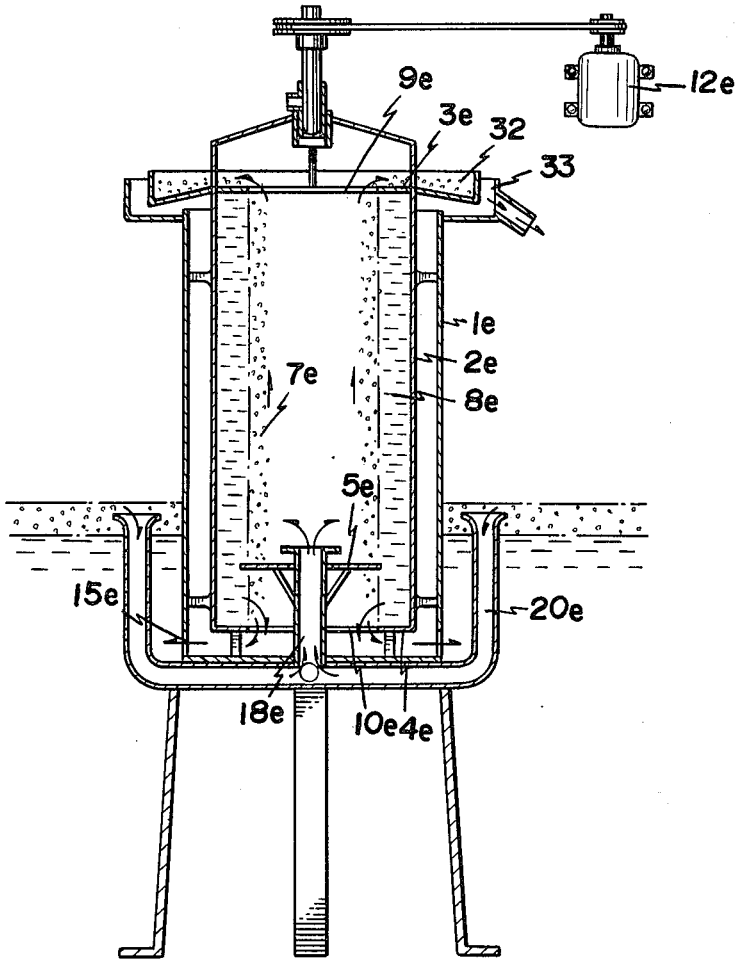
FIG. 6 is a vertical sectional view of another alternate embodiment showing the main part of an apparatus for separating mixed liquid according to a fourth embodiment of the present invention.

A variation of the fifth embodiment of the present invention is shown in FIG. 6. In FIG. 6 an outer cylinder 1*e* contains an inner rotary cylinder 2*e* forming a separating chamber and is disposed on inlet pipe portions 20*e* which are joined at a cross to lead to an inlet passage 18*e*. The inlet passage 18*e* opens into the inner cylinder 2*e* at a position not exceeding or extending above the level of the inlet of the inlet pipe portions 20*e*. A divisional disk 5*e* is mounted at the inlet of the passage 18 and the disk 5*e* has a diameter exceeding that of the top and the bottom openings 9*e* and 10 of the inner cylinder 2*e*. To the upper part of the inner cylinder 2 there is fixed a saucer-like element 32 arranged in such a manner as to be contained in another saucer-like element 33 which is fixed to the top of the outer cylinder 1*e* and leaving a space therebetween in order to rotate therein.

When the apparatus of this latter embodiment is positioned in the mixed liquid so that the inlet portin of the pipe 20*e* is located in the layer of liquid of lesser specific gravity and the electric motor 12*e* is operated, the liquid to be separated (the greater part of which is liquid of small specific gravity) flows into the inner cylinder 2*e* which is rotated by the electric motor via the shaft 11*e*, through the inlet passage 18*e* and is scattered with the divisional disk 5*e*. At the same time of flowing therein, the liquid is subjected to centrifugal force to thereby be separated into two vertical extending layers 7*e* and 8*e* of lesser and the greater specific gravities. The liquid of lesser specific gravity flows out of the opening 9*e* to the saucer-like element 32 to be received in the outer saucer-like element 33 to be discharged from a hose connected thereto. On the other hand, the liquid centrifuged around the inner cylinder 2*e* flows out of the opening 10*e* to be discharged from the outlets of the outer cylinder.

Figure 7:
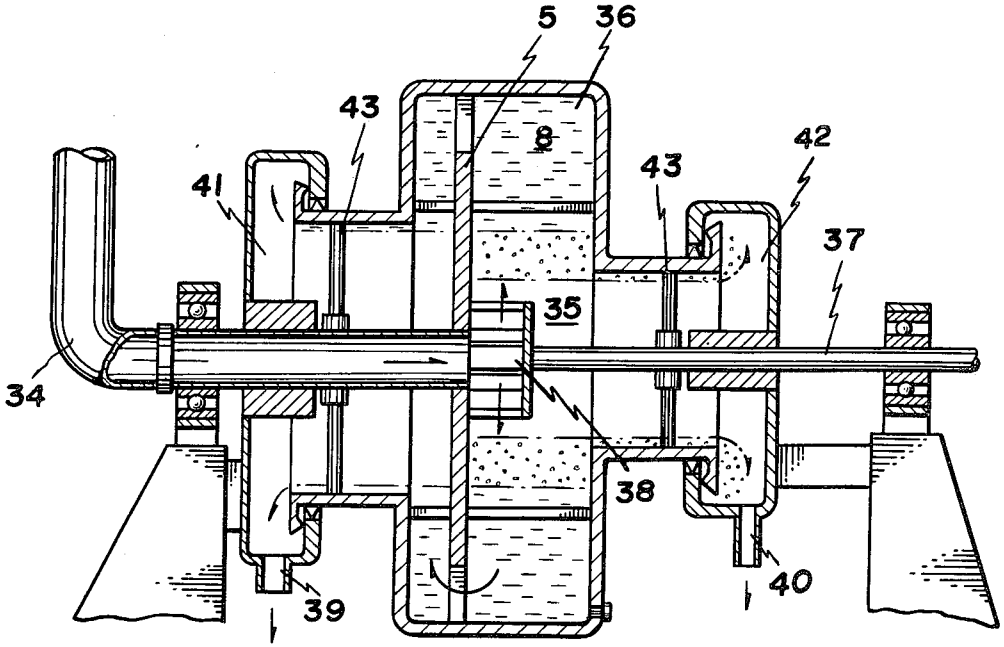
FIG. 7 is a vertical sectional view of another alternate embodiment showing the main part of an apparatus for separating mixed liquid according to a fifth embodiment of the present invention.

In the sixth embodiment of the present invention shown in FIG. 7, a pipe 34 for introducing mixed liquid opens into a separating chamber 35 at an expanded portion 36 and includes a divisional disk 5 mounted at the end thereof. On the other hand, a rotary shaft 37 extends through the separating chamber from the opposite direction to form an outlet portion 38 between the divisional disk 5 and the shaft and which is partitioned by a plurality of bars. At both ends of the separating chamber 35 there are provided compartments 41 and 42 for receiving and letting each separated liquid flow out to the outlet pipes 39 and 40 respectively.

When the shaft 37 is rotated by an electric motor (not shown), the separating chamber 35 and both receiving compartments 41, 42 rotate together. Supporting bars 43 are disposed suitably at the narrower portions of the chamber 35 to generate centrifugal force in the chamber. Since the opening to the separating chamber 41 has a larger diameter than the opening to the separating chamber 42, the liquid of lesser specific gravity centrifuged on the inside is discharged to the right and that of higher specific gravity flows through openings in the divisional disk 5 to pass to the left with the effects of the centrifugal force somewhat lessened or weakened by the divisional disk 5 which has a diameter more than that of the left cylindrical portion.

While the invention has been described by means of specific examples and in specific embodiments, it is not intended to be limited thereto, for obvious modifications will occur to those silled in the art without departing from the spirit and scope of the invention.

What is claimed is:

1. Apparatus for separating a mixed liquid containing components of different specific gravities, comprising an outer cylinder means having a discharge opening at a lower portion thereof through which separated components of higher specific gravity are discharged, an inner cylinder means disposed in said outer cylinder means, drive means for rotating said inner cylinder means, inlet means for introducing said mixed liquid to said inner cylinder means, said inner cylinder means having a concentric opening at the upper longitudinal end thereof through which separated components of lesser specific gravity pass, receiving means mounted on said outer cylinder means for receiving said separated components of lesser specific gravity from said concentric opening, disk means mounted within said inner cylinder means, said disk means being disposed at the lower end portion of said inner cylinder means and being arranged such that generally inner and outer concentric columns of separated components of lesser and greater specific gravities respectively extend between said disk means and said upper longitudinal end of said inner cylinder means, said outer concentric column of separated components of higher specific gravity passing to said discharge opening in said outer cylinder means.

2. Apparatus according to claim 1 wherein said inlet means comprises a casing mounted on a lower portion of said outer cylinder means, said casing having an inlet opening at a location intermediate the longitudinal ends of said outer cylinder means, whereby the lower portion of said outer cylinder means is adapted to be submerged in a body of mixed liquid such that the lighter liquid components floating on the surface of said body of water tend to pass into said inlet opening.

3. Apparatus according to claim 2 wherein said drive means includes an electric motor mounted on said receiving means and a drive shaft extending axially of said inner cylinder means, and bearing means of said casing rotatably supporting one end of said drive shaft.

4. Apparatus according to claim 1 wherein said inner cylinder means is provided with a concentric opening in the lower longitudinal end thereof which is substantially the same diameter as said concentric opening in the upper longitudinal end of said inner cylinder means, said inlet means including an inlet pipe extending through said concentric opening in the lower longitudinal end of said inner cylinder means.

5. Apparatus according to claim 4 wherein said disk means is attached to said inlet pipe, and a plurality of disk elements disposed within said inner cylinder means below said disk means, said disk elements being attached to said inlet pipe.

6. Apparatus according to claim 1 wherein said inlet means comprises an inlet pipe passing through said receiving means to extend downwardly into said inner cylinder means.

7. Apparatus according to claim 6 wherein said drive means comprises a drive shaft axially arranged relative to said inner cylinder means, said drive shaft being disposed in said inlet pipe.

8. Apparatus according to claim 1 wherein said receiving means comprises a first saucer-like element fixed to an upper portion of said outer cylinder means, a second saucer-like element fixed to an upper portion of said inner cylinder means, said first and second saucer-like elements being spaced from one another and arranged such that the separated lighter liquid components pass from said concentric opening in the upper end of said inner cylinder means to said first saucer-like element and thence to said second saucer-like element.

* * * * *